United States Patent [19]

Hammelmann

[11] 4,264,281

[45] Apr. 28, 1981

[54] PUMP WITH AN AUTOMATICALLY ADJUSTED OUTPUT RATE

[76] Inventor: Paul Hammelmann, Zum Sundern 17, D-4740 Oelde 1, Fed. Rep. of Germany

[21] Appl. No.: 36,498

[22] Filed: May 7, 1979

[30] Foreign Application Priority Data

May 11, 1978 [DE] Fed. Rep. of Germany ..... 2820547

[51] Int. Cl.[3] ..... F04B 49/00

[52] U.S. Cl. ..... 417/218; 92/13.1

[58] Field of Search ..... 417/218; 92/13.1, 13.7

[56] References Cited

U.S. PATENT DOCUMENTS

| | | | |
|---|---|---|---|
| 635,258 | 10/1899 | Lange | 417/218 |
| 1,813,078 | 7/1931 | Nyrop | 417/218 |
| 2,472,104 | 6/1949 | Grant et al. | 417/218 |
| 2,830,455 | 4/1958 | Harmon | 92/13.7 |
| 2,898,867 | 8/1959 | Saalfrank | 92/13.1 X |
| 3,901,231 | 8/1975 | Olson | 92/13.7 X |

*Primary Examiner*—Carlton R. Croyle
*Assistant Examiner*—Edward Look
*Attorney, Agent, or Firm*—Peter K. Kontler

[57] ABSTRACT

A positive displacement pump, especially a high-pressure piston pump, has a piston which is mounted for reciprocation within a pumping chamber. The piston is reciprocated by a drive including a crank, a first connecting link eccentrically mounted on the crank, a second connecting link articulated to the first connecting link and to the piston, and a control link connected to said first and second connecting links for pivoting about a common axis therewith and having a free end portion supporting a roller movable along and in contact with a curved cam surface. The roller is held in contact with the cam surface by a pivotally mounted support link. A movable component of a cylinder-and-piston unit displaces the roller and thus the control link into selected positions along the cam surface in dependence on the pressure of a medium admitted thereto which corresponds to the pressure in the outlet port of the pump for adjusting the output rate of the pump to higher levels for lower pressures and to lower levels for higher pressures.

10 Claims, 4 Drawing Figures

PUMP WITH AN AUTOMATICALLY ADJUSTED OUTPUT RATE

BACKGROUND OF THE INVENTION

The present invention relates to pumps in general, and more particularly to high-pressure piston pumps including one or more pistons and having adjustable output rates.

It is already known to use plunger-type high-pressure pumps, in which the pressure-volume ratio remains constant, in various applications, such as in hydrodynamic cleaning operations, in hydraulic or jet mining of coal or similar substances, in operation of hydraulic presses, as process pumps in diverse treatment installations, as homogenizers, and the like. In these pumps, the output rate (the amount being pumped per unit time) remains the same as long as the speed at which the pump is driven is maintained constant. Consequently, when it is necessary to change the output rates of pumps of this type, it can be done, in one case, by providing equipment for changing the speed at which the respective pump is being driven or, in another case, in pumps of the type here under consideration where the pumping action is the result of reciprocation of at least one piston or plunger within and with respect to an associated cylinder, by providing equipment capable of adjusting the length of the stroke of the piston or plunger. The conventional equipment of this type is very complex and hence expensive.

Another possibility of adjusting the output rate of the pump of the type discussed here is to resort to the use of bypass valves in the discharge or high-pressure line of the pump or within the pump itself. As a matter of fact, because of the relative simplicity and inexpensiveness of the equipment used for achieving this expedient, this solution to the problem of adjusting the output rate of the plunger-type high-pressure pumps is currently in widespread use. Under these circumstances, an amount of the fluid being pumped which is not needed for the operation of the device to which the fluid is being supplied flows through this bypass valve back to the suction side of the pump, or more particularly into an appropriate reservoir from which the pump withdraws the fluid, and the fluid is being heated during its passage through the bypass valve and the conduits leading to the suction side. Of course, the conversion of the mechanical energy into thermal energy is disadvantageous for several reasons. First of all, the increased heat content of the fluid is usually undesirable since the consistency or other properties of the fluid may be adversely affected thereby. Thus, it is often necessary to cool the fluid before it is readmitted to the pump which, in turn, results in thermal pollution of the environment. However, even in the absence of cooling by a special cooling equipment, the increased heat content of the fluid will be dissipated into the environment, with similar consequences. Last but not least, the amount of energy which is converted into thermal energy is to be considered to be wasted in most instances, so that the overall efficiency of the pump is reduced.

When the pumps of the above type are being used for rapid approach of presses, during the pressing of protective caps against the mine roof in mining operations, during the advancement of the lining and of the mining machinery also in mining operations, it is necessary to bridge idle intervals during which the lifting cylinder-and-piston unit is to be filled. Under these circumstances, only the frictional resistance of the various parts of the equipment is to be overcome at first. In order to obtain short time intervals for these phases of the operation of the equipment, it is necessary or advantageous to supply the equipment with large amounts of the working medium during these phases of operation. Then, after the rapid-approach phase, there follows a period of time during which the pressure of the working medium which is required for operating the equipment is built up to the desired level which is then being maintained over an extended period of time.

OBJECTS AND SUMMARY OF THE INVENTION

It is an object of the invention to develop a piston-type high-pressure pump for use especially in the above applications, which does not exhibit the drawbacks of the conventional pumps of this type.

Another object of the present invention is to so construct the pump of the type here under consideration that the output rate thereof is adjusted in a stepless manner in dependence on the pressure prevailing at the output side of the pump and that the maximum power output remains substantially constant.

It is a concomitant object of the present invention to so design the adjusting mechanism used in the pump as to be very simple and dependable.

A further object of the instant invention is to provide a pump with an infinitesimally adjustable output rate, which pump is simple in construction, inexpensive to manufacture, assemble and use, and yet reliable in operation.

One feature of the present invention resides in the provision of a pump with an adjustable output rate which comprises a housing defining a pumping chamber and inlet and outlet ports communicating with the pumping chamber; inlet and outlet valves respectively mounted in and establishing and interrupting communicating of the pumping chamber with the inlet and outlet ports; a piston mounted in the housing for reciprocation and extending to a greater and lesser extent into the pumping chamber in its extended and retracted position, respectively; a support rigid with the housing, and means for reciprocating the piston, including a crank having a driving portion rotatable about an axis which is stationary relative to the support and an eccentric portion rigid with the driving portion and offset therefrom transversely of the axis to orbit the latter, a first connecting link having two end portions one of which is tiltably mounted on the eccentric portion of the crank, a second connecting link having two ends respectively articulated to the other end portion of the first link and to the piston, and a control link pivotally connected to at least one of the connecting links (preferably joined to both of them for pivoting about a common axis) and having a free end portion. The pump further includes means for adjusting the extent of reciprocation of the piston, including means for mounting the free end portion of the control link on the support for tilting and displacement in a predetermined path relative to the support, and means for displacing the free end portion of the control link in the aforementioned path and for holding the control link in a selected position within the path. It is advantageous when the mounting means includes a cam track rigid with the support and having a curved cam surface, and a cam follower contacting the cam surface in each position of the control link within the path. The cam surface is preferably so oriented relative to the trajectory of reciprocation of the piston that the extent of reciprocation of the piston is the largest in one and the smallest in the other end position of the free end portion of the control link within the path.

It is currently preferred to construct the displacing means as a cylinder-and-piston unit having a stationary component (cylinder) rigid with the support and a movable component (actuating piston) operatively connected with the free end portion of the control link, and means for supplying a pressurized medium to the unit (a conduit connecting the unit with the outlet port) for displacing the movable component substantially along the path in dependence on the pressure of the pressurized medium toward lower output rates for higher pressures and vice versa.

As a result of the use of the linkage consisting of the connecting and control links (and also a support link yet to be discussed), which linkage has the capability of having its length which is determinative of the extent of the stroke of the piston adjusted in a continuous manner in conformity with a curved cam surface, it is possible to adjust the extent of the stroke of the piston in a simple manner in dependence on the pressure of the high-pressure medium being pumped and thus on the amount of the medium being pumped.

The novel features which are considered as characteristic of the invention are set forth in particular in the appended claims. The improved pump itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENT

Figure 1:
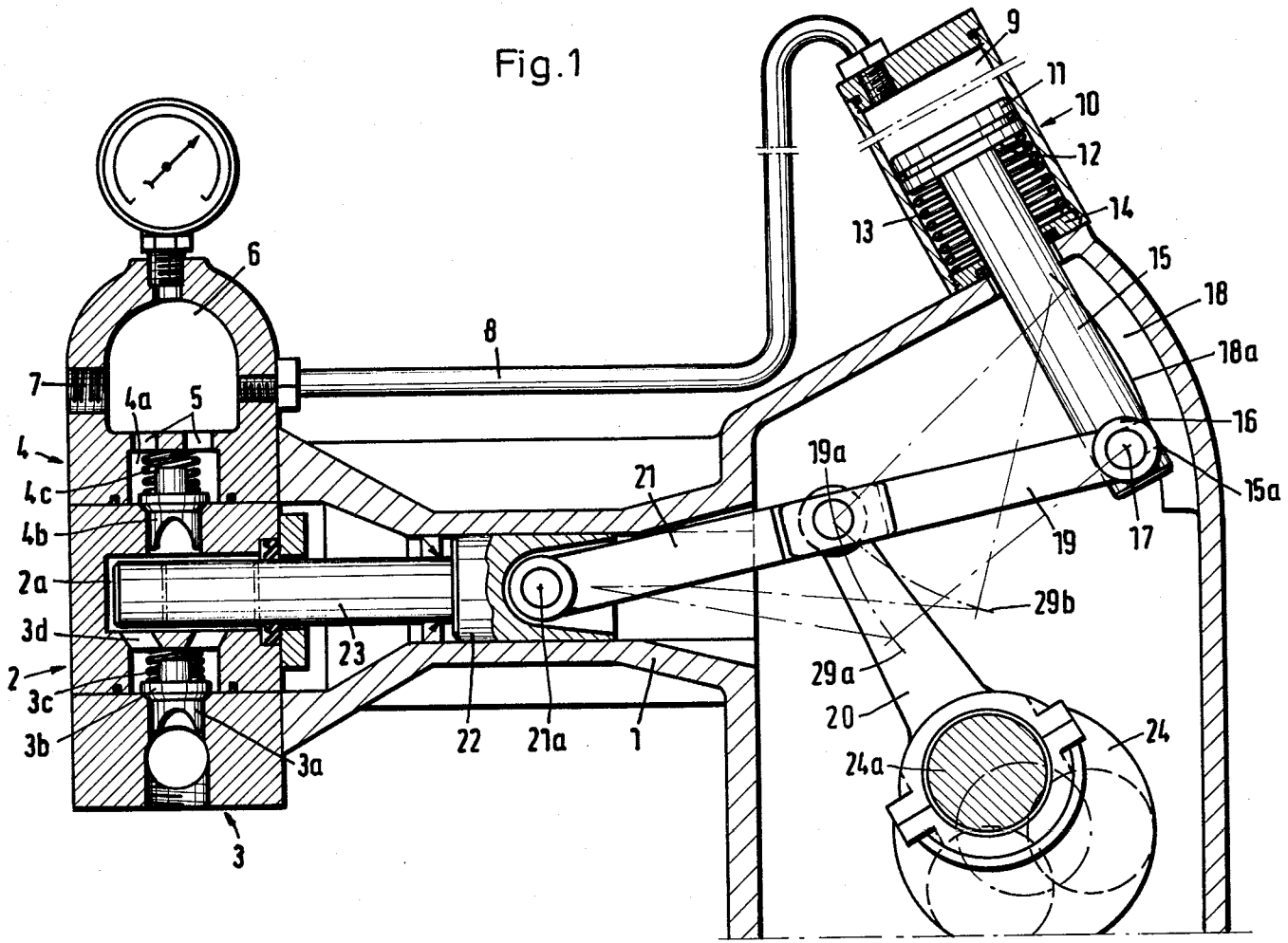
FIG. 1 is a longitudinal sectional view of the pump of the invention, in a position of minimum piston stroke and with the piston in its extended position.

Referring now to the drawings in detail, and first to FIG. 1 thereof, the reference numeral 1 denotes a housing of the pump of the present invention. A pumping head 2, which is rigidly and sealingly connected to the housing 1, bounds a pumping chamber 2*a* and includes a suction part 3 and a discharge part 4.

The suction part 3 includes a suction port 3*a*, a suction valve body 3*b* cooperating with a valve seat around the suction port 3*a* to establish and interrupt communication therewith, a spring 3*c* urging the suction valve body 3*b* towards its interrupting position, and a plurality of passages 3*d* establishing communication of the pumping chamber 2*a* with a space accommodating the suction valve body 3*b* and the spring 3*c*. Similarly, the discharge part 4 includes a discharge port 4*a*, a discharge valve body 4*b*, a spring 4*c* and a plurality of passages 5 connecting the discharge port 4*a* with a space 6 which, in turn, communicates with an outlet port 7 to which a non-illustrated conduit to a consuming device for the pressurized working fluid is usually connected.

Another conduit 8 also communicates with the space 6, the conduit 8 leading to an actuating chamber 9 of a cylinder-and-piston unit 10. An actuating piston 11 is slidingly received in the actuating chamber 9. The pressurized medium from the space 6 is constantly admitted, at the pressure then prevailing in the space 6, into the actuating chamber 9 of the unit 10 and acts on one side of the actuating piston 11 through the conduit 8. The actuating piston 11 has a surface 12 which faces away from the actuating chamber 9, and a spring 13, one end of which abuts an end plate 14 of the unit 10, rests against the surface 12 and thus permanently urges the actuating piston 11 in the opposite axial direction.

The piston 11 is rigidly connected with a piston rod 15 which is provided with a transverse guide 15*a*. A sliding member 16 which can be constituted, for instance, by a roller, is supported in the transverse guide 15*a* of the piston rod 15 for movement with the piston rod 15 in the axial direction of the latter, and also for a slight compensating movement transversely of the piston rod 15 within the confines of the transverse guide 15*a*. The reason for this transverse movability will become apparent as the discussion proceeds. Furthermore, in the event that the sliding member 16 is a roller, it is rotatable about the axis of a shaft 17.

The sliding member 16 cooperates with and tracks a cam surface 18*a* of a cam track 18, so that it will hereafter be referred to as a cam follower. The cam surface 18*a* is arcuate (preferably cylindrical and circular in cross section). On the other hand, the piston rod 15 moves along a straight path. Thus, for the cam follower 16 to be able to follow the cam surface 18*a*, provision must be made for movement of the shaft 17 of the cam follower 16 transversely of the piston rod 15 to compensate for the difference between the straight path of movement of the piston rod 15 and the arcuate path of movement of the shaft 17 for the cam follower 16. This is achieved by the provision of the transverse guide 15*a* on the piston rod 15. However, it will be appreciated that this compensation could be provided for in other ways as well, for instance, by appropriately configurating the shaft 17 of the cam follower 16.

A control link 19 is pivotally mounted on the shaft 17 at one of its ends, and the other end thereof is pivotally connected to one end of a first connecting link 20 and to one end of a second connecting link 21. While this connecting of the links 19,20 and 21 for pivoting about a common pivot 19*a* is particularly simple and otherwise advantageous, it is to be understood that the control link 19 could be connected to only one of the connecting links 20,21 at a location remote from the juncture of the connecting links 20,21.

The other end of the second connecting link 21 is articulately connected by a pivot 21*a* to a cross-head 22 by means of which a pumping piston 23 is set into reciprocatory motion. The other end of the first connecting link 20 is tiltably mounted on an eccentric portion 24*a* of a crank drive 24 which, in turn, is rotated during the operation of the pump by a non-illustrated conventional prime mover, as illustrated, in the counterclockwise direction.

Figure 2:
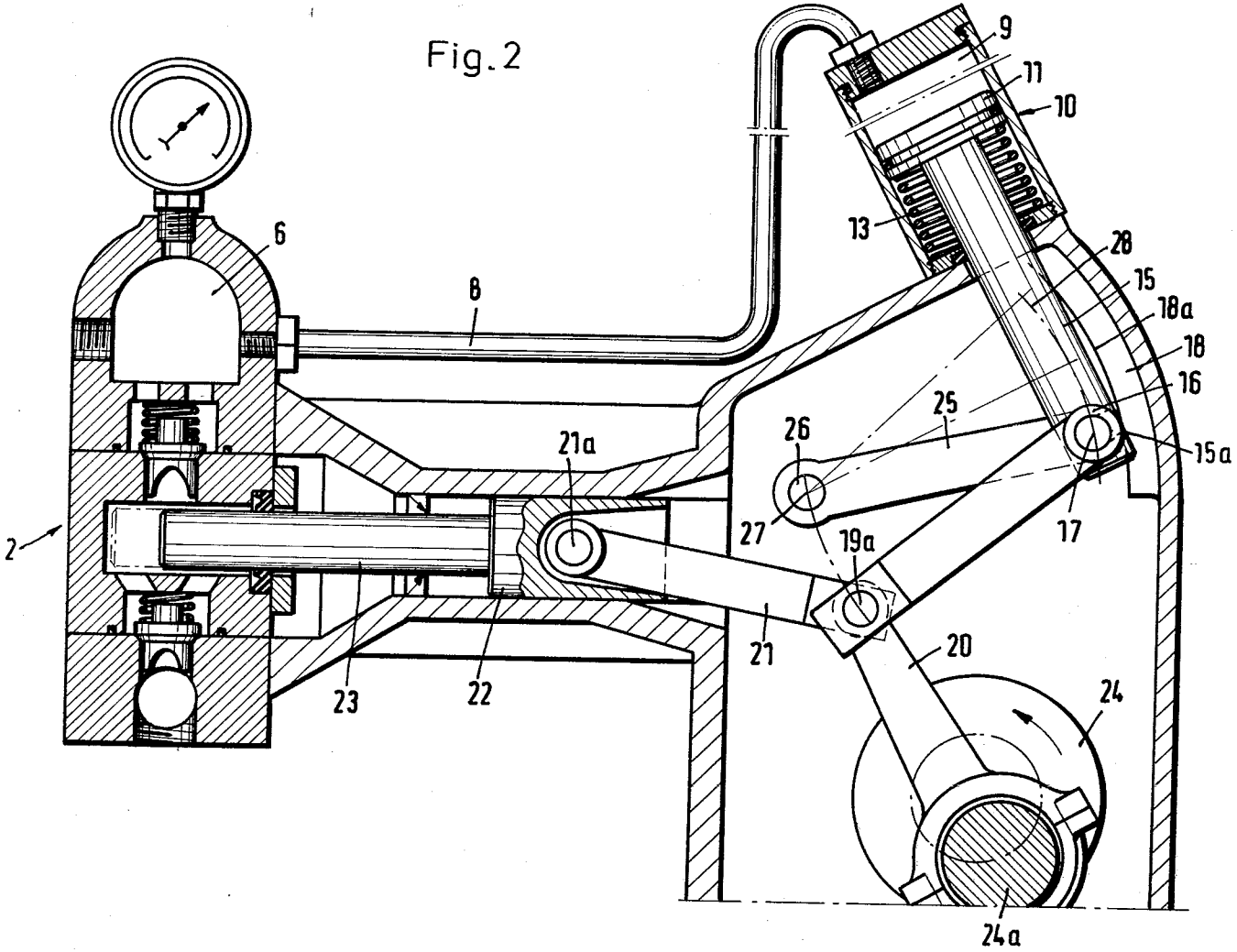
FIG. 2 is a view similar to that of FIG. 1 but with the piston in its retracted position.

In the position of the control link 19 and of the unit 10 which is illustrated in FIGS. 1 and 2, the pumping piston 23 operates with the smallest stroke and thus delivers the smallest amount of the pressurized working medium at the highest pressure into the discharge port 4a during its working stroke.

Under these circumstances, the spring 13 accommodated within the unit 10 is compressed by the actuating piston 11 as a result of the action of the highly pressurized medium admitted into the actuating chamber 9 of the unit 10 therein. As a consequence thereof, the cam follower 16 is displaced along the cam surface 18a into one end position.

A support link 25 is also tiltably supported on the axis 17 of the cam follower 16 at one of its ends, while the other end thereof is pivotally supported on a pivot 26 having an axis 27 which is stationary relative to the housing 1, particularly to a support part of the housing which accommodates all of the links 19,20,21 and 25 and supports the crank 24 and the unit 10, and also is provided with the cam track 18. The purpose of the support link 25 is to confine the shaft 17 of the cam follower 16 to movement along the cam surface 18a in a trajectory 28 to maintain the cam follower 16 in continuous contact with the cam surface 18a.

FIGS. 1 and 2 show the components in two positions one of which corresponds to the end of the working or pumping stroke, and the other to the end of the suction stroke of the pumping piston 23, in a situation where the minimum amount of the working medium is discharged at the highest pressure into the discharge port 4a during the pumping stroke of the piston 23. The length of the stroke of the piston 3 in this situation can be seen when the positions of the piston 23 in these two Figures are compared. FIG. 1 shows the pumping piston 23 in its extended position and FIG. 2 shows the piston 23 in its retracted position.

As soon as the pressure of the working medium in the space 6 starts to diminish (due to the consumption of the working medium by the non-illustrated consuming device), the pressure in the actuating chamber 9 of the unit 10 is reduced accordingly and so is the force with which the working medium acts on the actuating piston 11. As a result of this, the compressed spring 13 displaces the piston 11 upwardly as considered in the drawing, and with it also the piston rod 15 and the shaft 17 of the cam follower 16, from the position illustrated in FIGS. 1 and 2 toward (and possibly into) the position illustrated in FIGS. 3 and 4.

Figure 3:
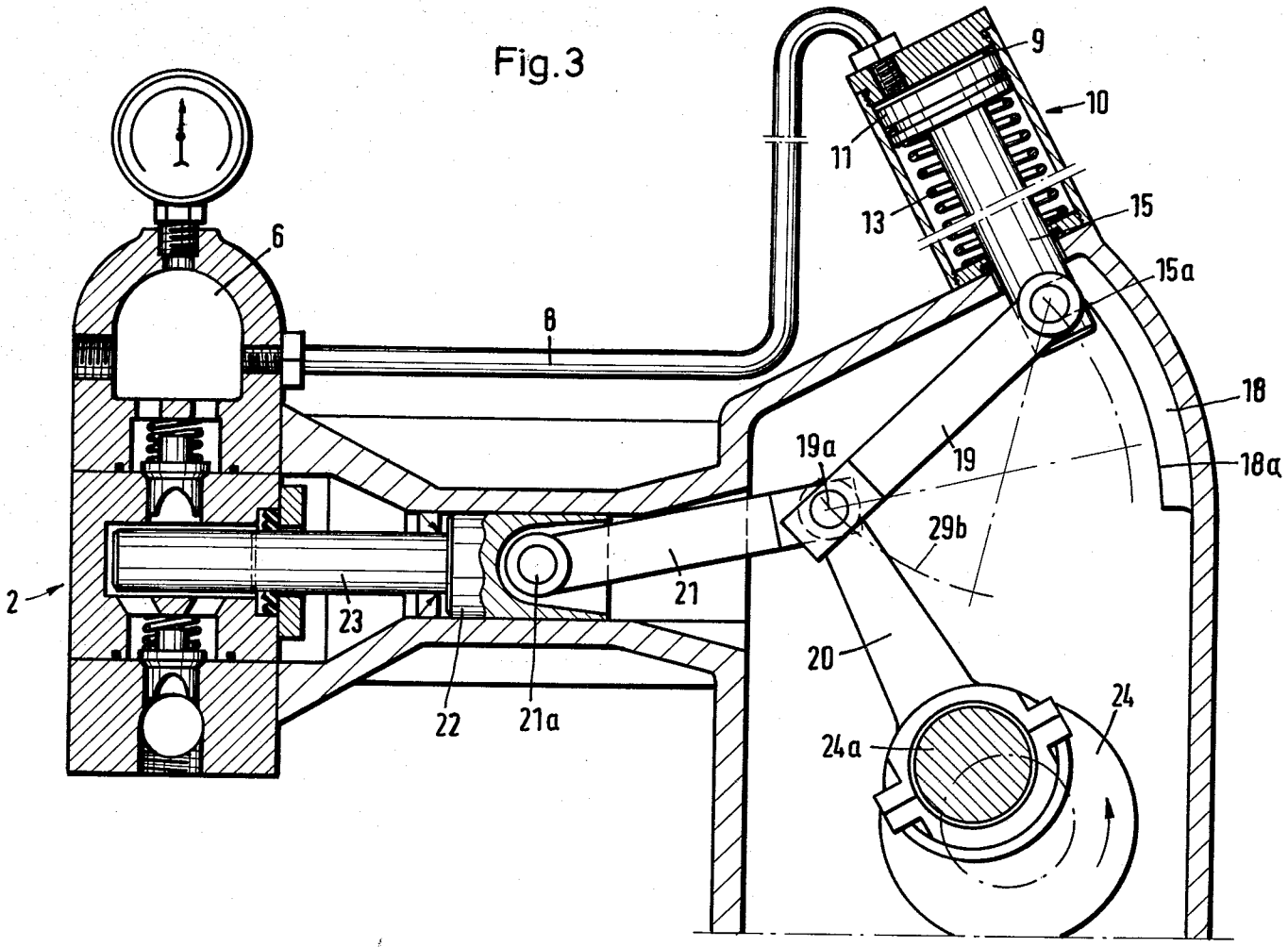
FIG. 3 is a view corresponding to FIG. 1 but in a position of maximum piston stroke and with the piston in its extended position.
Figure 4:
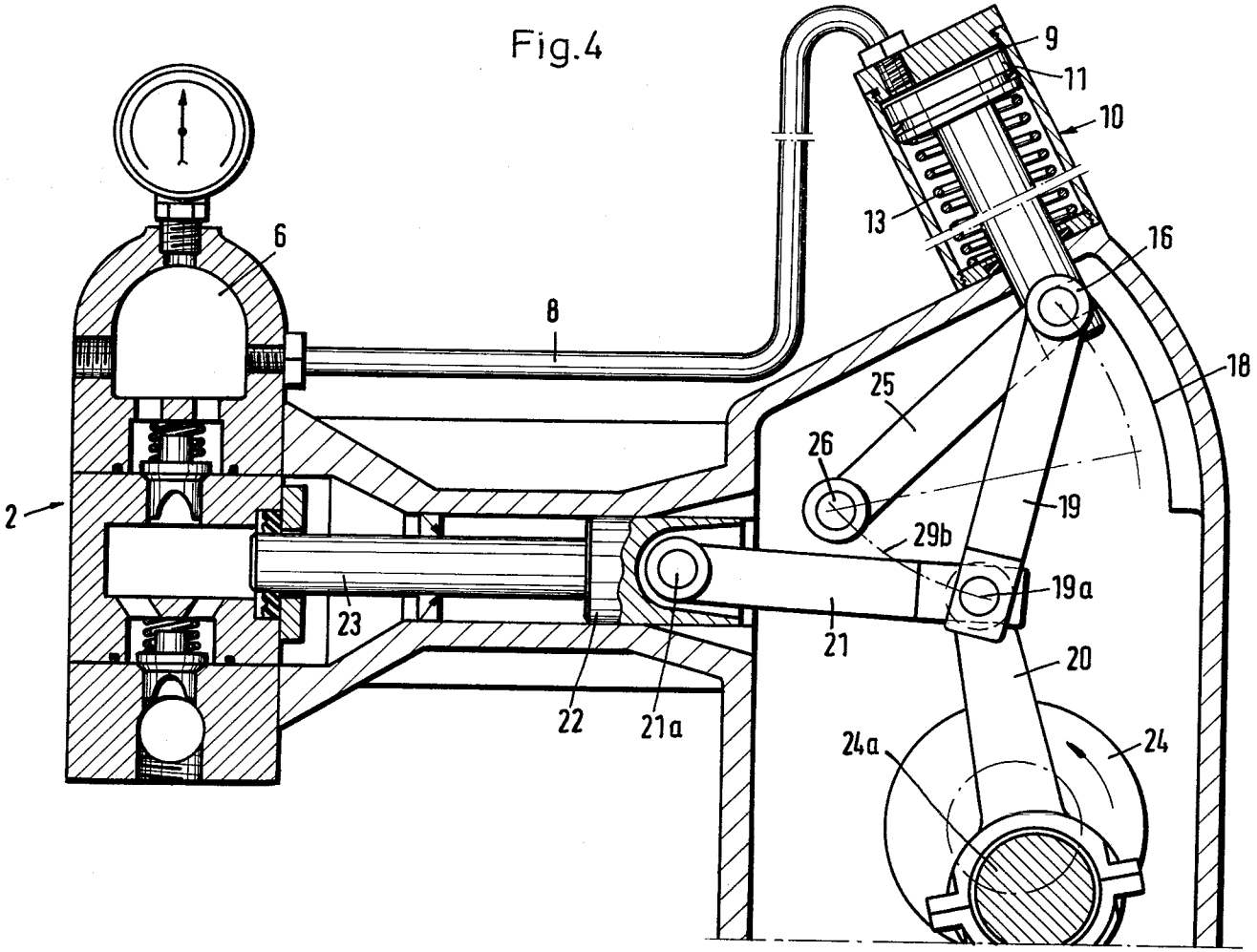
FIG. 4 is a view similar to that of FIG. 3 but with the piston in its retracted position.

When the pressure reduction in the actuating chamber 9 of the unit 10 is large enough, the piston 11 and the piston rod 15 (and with it also the shaft 17) are moved all the way into the position of FIGS. 3 and 4. Then, the cam follower 16 is located at the upper end of the cam track 18. The spring 13 is substantially relieved of tension.

As a comparison of FIGS. 1 and 2, on the one hand, and FIGS. 3 and 4, on the other hand, will reveal, the axis of the pivot 19a will travel along two circular trajectories 29a and 29b in each of the end positions of the cam follower 16 with reference to the cam surface 18a. Of course, when the cam follower 16 assumes any position intermediate the end positions, the trajectory of the axis of the pivot 19a will be located between the trajectories 29a and 29b and will have the same radius of curvature.

As an examination of the Figures will reveal, the extent of the axial displacement (stroke) of the piston 23 is determined by the trajectory in which the axis of the pivot 19a moves. For the trajectory 29b, the extent of reciprocation is the greatest, and the trajectory 29a the smallest. Then, intermediate values are obtained for intermediate positions of the shaft 17 of the cam follower 16.

Similarly to the aforediscussed situation, FIGS. 3 and 4 differ from one another only in that the piston 23 and the linkage 19,20,21,24 and 25 are in positions which respectively correspond to the extended and retracted positions of the piston 23.

It may be seen from the above explanation that the pump and especially the adjusting mechanism therefor are very simple and thus are not prone to any malfunctions during the operation. In addition thereto, it is possible to obtain a very close conformity of the adjustment of the output rate with the behavior of the pressure in the discharge line or port of the pump. Taken together, these advantages and those which have been mentioned previously make for a very simple, rugged, inexpensive and reliable construction of the pump of the invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. A pump with an adjustable output rate, comprising a housing defining a pumping chamber and inlet and outlet ports communicating with said pumping chamber; inlet and outlet valves respectively mounted in and establishing and interrupting communication between said pumping chamber and said inlet and outlet ports; a piston mounted in said housing for reciprocatory movement between extended and retracted positions and extending to a greater and lesser extent into said pumping chamber in its extended and retracted positions, respectively; a support rigid with said housing; means for reciprocating said piston, including a crank having a driving portion rotatable about an axis which is stationary relative to said support and an eccentric portion rigid with said driving portion and offset therefrom transversely of said axis to orbit the latter, a first connecting link having two end portions one of which is pivotably mounted on said excentric portion of said crank, a second connecting link having two ends respectively articulately connected to the other end portion of said first link and to said piston, and a control link pivotally connected to at least one of said connecting links and having a free end portion, said other end portion of said first link, the respective end of said second link and said control link being joined for pivoting about a common pivot axis; and means for adjusting the extent of reciprocation of said piston, including means for mounting said free end portion of said control link on said support for pivoting and displacement relative to said support along a predetermined path, and means for displacing said free end portion of said control link along said path and for holding the same in a selected position within said path.

2. A pump as defined in claim 1, wherein said displacing means includes a cylinder-and-piston unit having a stationary component rigid with said support and a movable component operatively connected with said free end portion of said control link, and means for supplying a pressurized medium to said unit for displacing said movable component thereof substantially along said path.

3. A pump as defined in claim 2, wherein said supplying means includes a conduit connecting said unit with said outlet port of said housing for supplying pressurized medium at the pressure prevailing in said outlet port to said unit and for displacing said movable component thereof in dependence on the magnitude of such pressure toward lower output rates for higher pressures, and vice versa.

4. A pump as defined in claim 3, wherein said movable component is an actuating piston accommodated in a piston chamber of the other component and subdividing the same into two compartments one of which communicates with said conduits, said unit further including at least one spring accommodated in the other compartment and urging said activating piston in a direction opposite to that attributable to the action of said pressurized medium on said actuating piston.

5. A pump with an adjustable output rate, comprising a housing defining a pumping chamber and inlet and outlet ports communicating with said pumping chamber; inlet and outlet valves respectively mounted in and establishing and interrupting communication between said pumping chamber and said inlet and outlet ports; a piston mounted in said housing for reciprocatory movement between extended and retracted positions and extending to a greater and lesser extent into said pumping chamber in its extended and retracted positions, respectively; a support rigid with said housing; means for reciprocating said piston, including a crank having a driving portion rotatable about an axis which is stationary relative to said support and an eccentric portion rigid with said driving portion and offset therefrom transversely of said axis to orbit the latter, a first connecting link having two end portions one of which is pivotably mounted on said eccentric portion of said crank, a second connecting link having two ends respectively articulately connected to the other end portion of said first link and to said piston, and a control link pivotally connected to at least one of said connecting links and having a free end portion; and means for adjusting the extent of reciprocation of said piston, including means for mounting said free end portion of said control link on said support for pivoting and displacement relative to said support along a predetermined path, said mouting means including a cam track rigid with said support and having a curved cam surface and a cam follower contacting said cam surface in each position of said control link within said path, said adjusting means further including means for displacing said free end portion of said control link along said path and for holding the same in a selected position within said path.

6. A pump as defined in claim 5, wherein said cam surface is so oriented relative to the trajectory of reciprocation of said piston that the extent of reciprocation of said piston is the largest in one and the smallest in the other end position of said free end portion of said control link within said path.

7. A pump as defined in claim 5, wherein said cam follower is a roller capable of rolling along said cam surface of said cam track.

8. A pump as defined in claim 5, wherein said mounting means for said free end portion of said control link further includes means for maintaining said cam follower in continuous contact with said cam surface of said cam track, including a support link pivotally mounted on said support and acting on said cam follower.

9. A pump with an adjustable output rate, comprising a housing defining a pumping chamber and inlet and outlet ports communicating with said pumping chamber; inlet and outlet valves respectively mounted in and establishing and interrupting communication between said pumping chamber and said inlet and outlet ports; a piston mounted in said housing for reciprocatory movement between extended and retracted positions and extending to a greater and lesser extent into said pumping chamber in its eextended and retracted positions, respectively; a support rigid with said housing; means for reciprocating said piston, including a crank having a driving portion rotatable about an axis which is stationary relative to said support and an eccentric portion rigid with said driving portion and offset therefrom transversely of said axis to orbit the latter, a first connecting link having two end portions one of which is pivotably mounted on said eccentric portion of said crank, a second connecting link having two ends respectively articulately connected to the other end portion of said first link and to said piston, and a control link pivotally connected to at least one of said connecting links and having a free end portion; and means for adjusting the extent of reciprocation of said piston, including means for mounting said free end portion of said control link on said support for pivoting and displacement relative to said support along a predetermined path, said mounting means including a support link pivotally mounted on said support and articulately connected to said free end portion of said control link, said adjusting means further including means for displacing said free end portion of said control link along said path and for holding the same in a selected position within said path.

10. A pump as defined in claim 9, wherein said links are so pivoted on said support, on said crank, and on one another, and so dimensioned that said second connecting link and said control link are aligned with each other and the eccentricity of said eccentric portion of said crank is aligned with a longitudinal axis of said first connecting link in a position of said links corresponding to the smallest extent of reciprocation of said piston.

* * * * *